United States Patent [19]

Fujii et al.

[11] 4,375,446

[45] Mar. 1, 1983

[54] PROCESS FOR THE PRODUCTION OF A NONWOVEN FABRIC

[75] Inventors: Shigeo Fujii; Tokuzo Ikeda; Takashi Mikami; Shuji Okano, all of Oi, Japan

[73] Assignee: Toa Nenryo Kogyo Kabushiki Kaisha, Tokyo, Japan

[21] Appl. No.: 167,637

[22] PCT Filed: May 1, 1979

[86] PCT No.: PCT/JP79/00108

§ 371 Date: Dec. 21, 1979

§ 102(e) Date: Dec. 21, 1979

[87] PCT Pub. No.: WO79/01014

PCT Pub. Date: Nov. 29, 1979

[30] Foreign Application Priority Data

May 1, 1978 [JP] Japan ..... 53-50745

[51] Int. Cl.[3] ..... D04H 3/16

[52] U.S. Cl. ..... 264/518; 156/167; 264/176 F

[58] Field of Search ..... 264/DIG. 75, 176 F, 264/518, 103, 164; 19/299; 28/103; 156/34

[56] References Cited

U.S. PATENT DOCUMENTS

| | | | |
|---|---|---|---|
| 2,897,874 | 8/1959 | Stalego et al. | 19/299 |
| 3,025,202 | 3/1962 | Morgan et al. | 156/34 |
| 3,535,187 | 10/1970 | Wood | 28/103 |
| 3,738,884 | 6/1973 | Soehngen | 264/164 |
| 3,844,097 | 10/1974 | Bobkowicz et al. | 264/103 |
| 3,920,362 | 11/1975 | Bradt | 264/164 |
| 4,042,740 | 8/1977 | Krueger | 264/DIG. 75 |
| 4,095,312 | 6/1978 | Haley | 28/103 |
| 4,100,324 | 7/1978 | Anderson et al. | 156/167 |
| 4,267,002 | 5/1981 | Sloan et al. | 156/167 |

*Primary Examiner*—Jay H. Woo

*Attorney, Agent, or Firm*—W. T. Clarke; M. B. Kurtzman

[57] ABSTRACT

A process for producing a thermoplastic nonwoven fabric having a uniform thickness and optionally napped fibers according to a melt blowing method, which comprises blowing a fiber stream consisting of melt blown fibers and a gas at a high speed onto a plate within a valley-like fiber-collecting zone formed by two plates having a large number of pores, to form a uniform nonwoven fabric without scattering fibers.

24 Claims, 24 Drawing Figures

FIG. 3
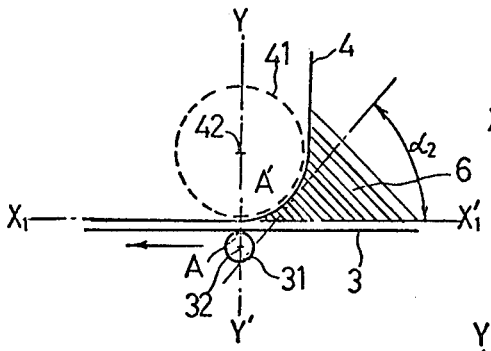
FIG. 4
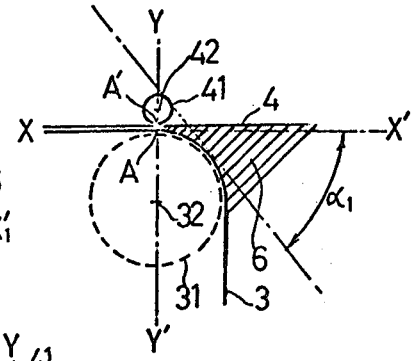
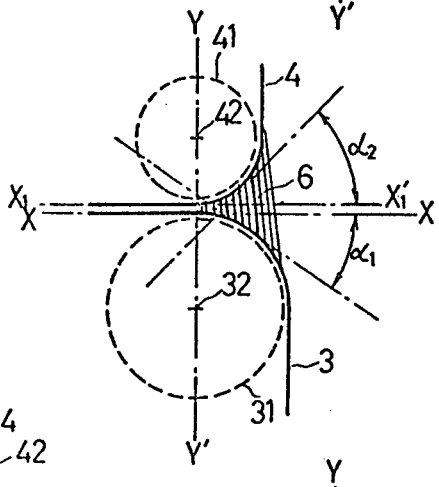
FIG. 5
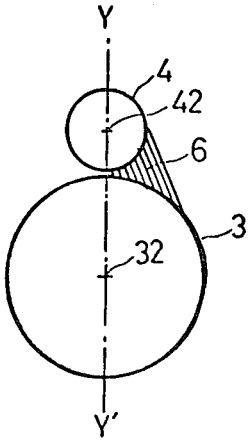
FIG. 6
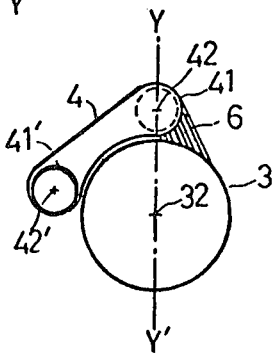
FIG. 7

FIG. 8(a)
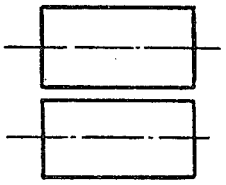
FIG. 8(b)
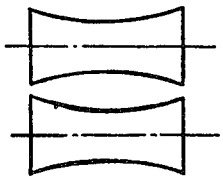
FIG. 8(c)
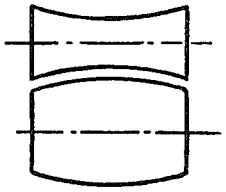
FIG. 8(d)
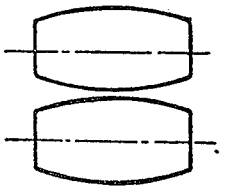
FIG. 8(e)
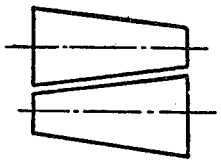
FIG. 8(f)
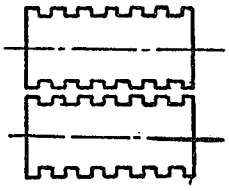
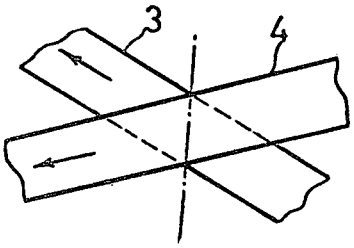
FIG. 9
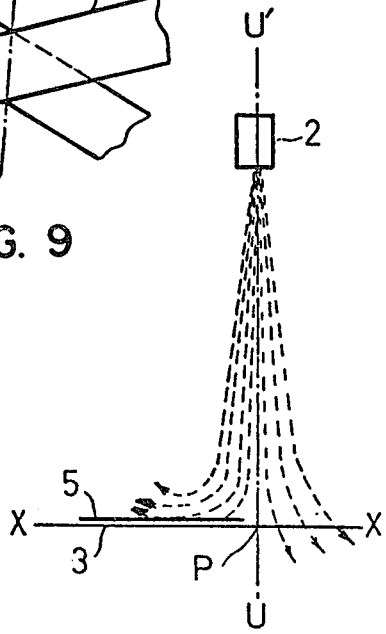
FIG. 11
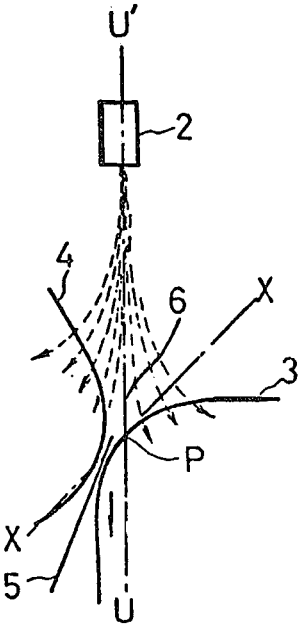
FIG. 10

FIG. 12
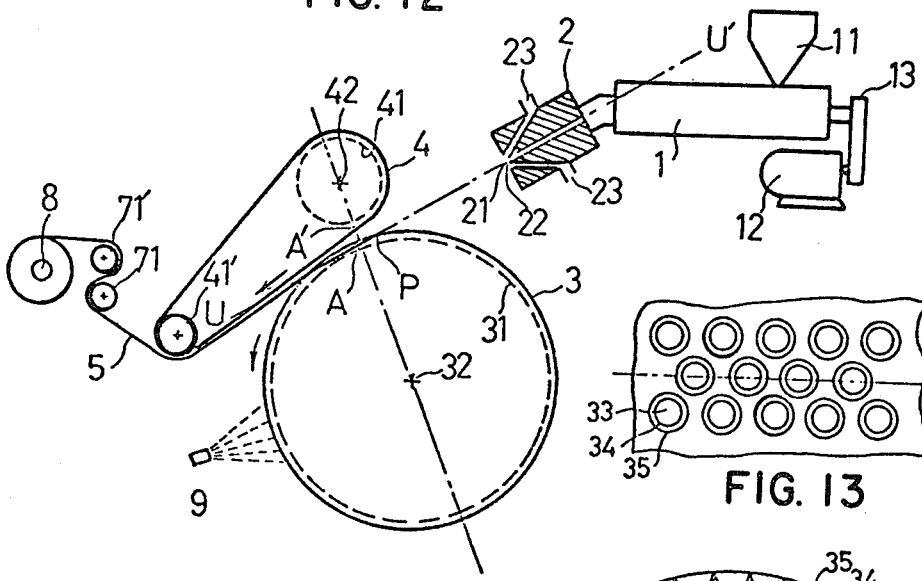
FIG. 13
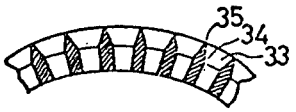
FIG. 14
FIG. 15
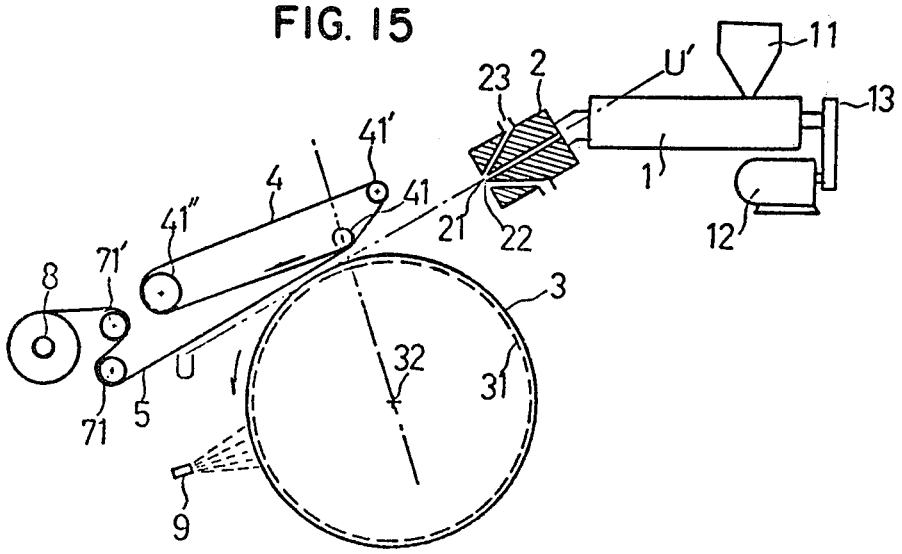

PROCESS FOR THE PRODUCTION OF A NONWOVEN FABRIC

TECHNICAL FIELD

This invention relates to an improved process for the production of a nonwoven fabric comprising spinning continuously a fused thermoplastic resin from a plurality of spinning holes provided in a spinning apparatus, while simultaneously jetting a gas at a high speed from gas discharging holes provided adjacent to the spinning holes to stretch fibers of the thermoplastic resin thereby forming a fiber stream consisting of the fibers and the gas, and then collecting the fiber stream.

BACKGROUND ARTS

Methods for the production of a nonwoven fabric comprising melt spinning a thermoplastic resin and blowing it as fine fibers against a moving collecting plate have been known as the "melt-blowing process" (Japanese Patent Kokai (Early-Publication) Nos. 10,258/1974, 48,921/1974 and 121,570/1975, or "jet-spinning process" (Japanese Patent Publication Nos. 25,871/1969 and 26,977/1969).

Since in these known methods, a fiber stream is simply collected on a flat or hollow-cylindrical collecting plate having a large number of pores, they have the disadvantages that a part of the fiber stream blown onto a collecting plate tends to be scattered together with the blown gas, and that the thickness and weight per unit area of a nonwoven fabric collected on a plate are uneven. For example, in the production of a nonwoven fabric, particularly bulky, made of such fine fibers as having a fiber diameter of several microns, the scattering of fibers is so remarkable that the workability and operation environment tend to be deteriorated and that the resulting product is uneven. In order to prevent this phenomenon, there has been proposed a method comprising forcedly withdrawing the gas blown against the collecting plate by using a sucking means provided on the back side of the collecting plate. However, this method is disadvantageous in that it is uneconomical because of needing power for the exhaust of the gas, that the displacement of the sucking means has a limit, and further in that if the displacement is increased, a nonwoven fabric in contact with the surface of the collecting plate may also be sucked such that the density thereof is increased, resulting in difficulty in obtaining a uniform and bulky nonwoven fabric.

Furthermore, the prior art methods only produce nonwoven fabrics wherein fibers are disposed in parallel with the surface of the nonwoven fabrics, but cannot produce nonwoven fabrics wherein fibers are arranged in the vertical direction to the surface (i.e. in parallel with the thickness direction).

As a result of intensive studies on a method for producing a bulky and uniform nonwoven fabric consisting of fine fibers, the inventors have found that a bulky and uniform nonwoven fabric consisting of fine fibers can very easily be obtained by blowing a fiber stream of a thermoplastic resin into a valley-like space zone formed by two plates having a large number of holes, and that in particular, a nonwoven fabric wherein fibers are vertical to the surface of the nonwoven fabric (in parallel with the thickness direction) can be obtained by blowing a fiber stream into an area where the two porous plates meet. The present invention has been accomplished based on this finding.

DISCLOSURE OF THE INVENTION

The present invention provides a process for the production of a nonwoven fabric comprising spinning continuously a molten thermoplastic resin from a plurality of spinning holes provided in a spinning apparatus thereby to spin fibers, while simultaneously jetting a gas at a high speed from gas discharging holes provided adjacent to the spinning holes to stretch the spun fibers of the thermoplastic resin, thereby forming a fiber stream consisting of the fibers and gas, and then blowing the fiber stream onto porous plate or plates to give a nonwoven fabric consisting of said fibers, characterized by arranging two movable plates respectively having a large number of pores so that they may come into contact with each other via the fibers to provide a contact region, and that they may also form a fiber-collecting zone in which the gap between the two porous plates increases as the distance increases from said contact region in the opposite direction to the movement of said plates, and blowing said fiber stream into said fiber-collecting zone in such a manner that the central plane of said fiber stream is directed within said fiber-collecting zone.

Examples of the thermoplastic resins used in the present invention are polyolefins, for example, homopolymers of $\alpha$-olefins such as ethylene, propylene, butene-1 and 4-methylpentene-1, copolymers of these monomers or mixtures of these polymers, polyamides such as nylon 6, nylon 66, nylon 612 and nylon 12 (commercial names or ganeral names) or mixtures thereof, polyester resins such as polyethylene terephthalate and polybutylene terephthalate, polyurethane resins, in particular, thermoplastic polyurethane resins, ethylene-vinyl acetate copolymers, ethylene-methacrylic acid ester copolymers and graft copolymers of polyolefins with unsaturated carboxylic acids or derivatives thereof, or mixtures of these thermoplastic resins.

A spinning apparatus used in the present invention consists of a die having a plurality of spinning holes and gas discharging holes provided adjacent to the spinning holes. A thermoplastic resin is supplied to the spinning holes through which it is continuously spun into fibers, and the spun fibers are simultaneously stretched into finer fibers by means of a gas jetted from the gas discharging holes at a high speed. Such a spinning apparatus may be any of such dies as disclosed in Japanese Patent Early-Publication Nos. 10258/1974, 48921/1974, 121570/1975, 4672/1975 and 67411/1976 and Japanese Patent Publication Nos. 25871/1969 and 26977/1969. In particular, the dies having the structures described in Japanese Patent Publication No. 25871/1969 and Japanese Patent Early-Publication No. 67411/1976 are preferably used.

In the process of the present invention, a thermoplastic resin is spun and simultaneously stretched into finer fibers by a gas blown at a high speed, and a fiber stream consisting of the fibers and the gas is blown into a fiber-collecting zone of a valley shape formed between two plates each having a large number of pores on its surface (for the convenience of explanation of the present invention, a porous plate onto which the fiber stream is blown is referred to as "a collecting plate," and the other plate is referred to as "a press plate"), in such a manner that the central plane of the fiber stream is directed to the fiber collecting zone.

As a high speed gas, air is usually used. However, depending on the type of resin selected, gases inert to particular resins such as nitrogen may be used.

The collecting plate and press plate used in the present invention may be plates having a number of pores or holes, for example, perforated plates prepared by making holes in thin plates of a metal or synthetic resin by a mechanical or chemical method, nets prepared by weaving wires of a metal or synthetic resin, porous plates made by fixing wires of a metal or synthetic resin at a predetermined interval to give slits, woven or nonwoven fabrics and the like. These plates can be used individually. However, in order to increase the mechanical strength thereof, it is also possible to use two or more sheets of them by lamination. In this case, it is desirable to use a thinner perforated plate having smaller holes as a surface layer and a thicker perforated plate having larger holes as a lining layer. Moreover, a woven or nonwoven fabric can be laid on the perforated plate as a surface layer. In addition, these woven or nonwoven fabrics may also be laminated to produce a layered nonwoven fabric. The shapes, sizes and distribution of the holes of these plates may optionally be determined to some extent on the basis of the properties of a nonwoven fabric to be prepared. In general, it is desirable to use a punched perforated plate or woven net of metal or a synthetic resin with a pore size of 5 to 200 mesh, preferably 10 to 40 mesh. The collecting plate and press plate are preferably of a shape of a belt or ring supported by a roll or a drum, or of a hollow-cylindrical shape.

When the collecting plate and the press plate are supported on such a hollow cylindrical body as a drum, the hollow cylindrical body may have pores of 1 to 50 mm, preferably 5 to 20 mm on the surface thereof.

The collecting plate and the press plate are arranged in such a manner that they come into contact with each other via collected fibers. In this case, the normals of both plates coincide with each other in a region where they are in contact. Both plates move in the same direction in the contact region. The collecting plate and the press plate are so arranged that a gap between them increases gradually in the upstream direction (opposite to the direction of movement of the plates). Accordingly, the collecting plate and the press plate form a valley-like space in the upstream area near the contact region. The bottom of the valley corresponds to the portion where both plates comes into contact with each other via the collected fibers. This valley-like space is referred to herein as "fiber-collecting zone." Within the fiber-collecting zone, the angle of divergence of the collecting plate (angle of the collecting plate forming with the tangent thereof at the point at which the collecting plate is in contact with the press plate) is 0° to 90°, and the angle of divergence of the press plate is also 0° to 90°.

Next, a line of intersection of the central surface in the longitudinal direction of the fiber stream with the collecting plate is referred to herein as "fiber-blown spot." The fiber-blown spot must be within the range of the fiber-collecting zone. More preferably, it is positioned at such a place on the surface of the collecting plate that the distance from the contact region to said place is measured at 5 times at most, particularly 3 times or less the width of the fiber stream on the surface of the collecting plate, said width being defined by the width of the expanse of fiber stream which would be formed at the position of the collecting plate, assuming that the collecting plate were absent. In particular, when the fiber-blown spot is positioned in the contact region of the collecting plate and the press plate, special effects are obtained.

The angle of blow of the fiber stream, i.e., an angle defined by the central line in the longitudinal direction of the fiber stream and the tangent of the collecting plate at the fiber-blown spot is generally 0 to 90 degrees, preferably 0 to 60 degrees. When the angle of blow is 0°, i.e., the fiber stream is in parallel with the tangent as the fiber-blown spot, the fiber stream is blown onto both of the collecting plate and the press plate. In this case, both the plates may be called as "collecting plates," since the collecting plate and the press plate are distinguished only for the convenience of illustration as set forth above. As a special example in which the angle of blow is 0°, the central line of the fiber stream in the longitudinal direction may be positioned in the contact region between the collecting plate and the press plate. Thus, when the blowing angle is almost 0 degree, a nonwoven fabric in which fibers are arranged substantially vertical to the surface of the nonwoven fabric may be prepared, depending upon the relationship between the width of the fiber stream and the distance between the collecting plate and the press plate in the contact region. Moreover, the central plane of the fiber stream (longitudinal cross sectional plane) is desirably in parallel with the line formed by the intersection of the normal plane of the collecting plate with the surface of the collecting plate in the contact region, or the line of intersection of the normal plane of the press plate with the surface of the press plate in the contact region, although this is not necessarily indispensable.

The fiber stream blown onto the collecting plate is formed into a nonwoven fabric by the separation of the gas from the fibers on the collecting plate. This nonwoven fabric is usually wound up after compression thereof to a predetermined thickness between the collecting plate and the press plate. In this case, the extent of the compression of the resulting nonwoven fabric by means of the collecting plate and the press plate should be suitably determined, depending on the form of a nonwoven fabric to be prepared, particularly the apparent density thereof. It must also be pointed out that compression is not always necessary depending on the application of the nonwoven fabric.

As mentioned above, according to the present invention, a fiber stream comprising fine fibers of a thermoplastic resin is blown at a high speed into a valley-like fiber-collecting zone formed by the opposing collecting plate and press plate each having a large number of pores in such a manner that the central plane of the fiber stream is directed to a fiber-blown spot within the fiber-collecting zone, whereby the fibers are collected, while the gas is extremely easily withdrawn through the pores of the press plate and the collecting plate. Therefore, a uniform nonwoven fabric may be produced without the scattering of fibers even though a special sucking means is not used. That is, the gas in the fiber stream is readily withdrawn through the perforated plates on both sides of the fiber-blown spot. As a result, the turbulence of the gas flow on the collecting plate decreases and, in particular, there is little gas flow passing over the surface of the resulting nonwoven fabric, so that the fibers are not scattered and even if partly scattered, they are collected by the collecting plate and the press plate. In the case of the present invention, in particular, since there are no fibers adhered to the parts of either the collecting plate or the press plate through which the gas of the fiber stream is withdrawn, the gas may be removed without any difficulty. Incidentally, when the collecting plate and the press plate are made of nonwoven or woven fabrics, gas cannot be easily removed through those nonwoven or woven fabrics because of small pores thereof, although the difficulty of removal of the gas varies depending on the thickness and pore size of the nonwoven or woven fabrics. Nevertheless, since the scattered fibers may be easily collected on the collecting plate and the press plate as compared with conventional processes, the effects of the present invention are sufficiently attained.

As mentioned above, the process of the present invention has eliminated those disadvantages of prior arts, thereby reducing the occurences of turbulent gas flows on both sides of the fiber-blown spot because of the withdrawal of the gas through the pores of the collecting plate and the press plate without any difficulty. Moreover, the present invention provides a nonwoven fabric of a uniform thickness, because the nonwoven fabric is compressed to a constant thickness by means of the collecting plate and the press plate. In addition, the present invention is characterized in providing a nonwoven fabric containing fibers arranged perpendicular to the surface of the nonwoven fabric by suitably selecting the spot to which the fiber stream is blown as mentioned above.

BRIEF EXPLANATION OF DRAWINGS

FIGS. 3 to 7 are schematic views of embodiments of the fiber-collecting zone according to the present invention, respectively;

FIG. 8 shows examples of the shapes of the collecting plate and the press plate in cross-section in the thickness direction thereof;

FIG. 9 is a schematic view showing a special example of the relative relation of the directions of movement of the collecting plate and the press plate;

FIGS. 10 and 11 show gas flows when the fiber stream is collected, FIG. 10 relating to the present invention and FIG. 11 relating to a known art;

FIGS. 12, 15, 16, 17 and 19 are schematic views showing the other embodiments of the present invention, respectively;

FIG. 13 shows pores provided on the surface of the drum supporting the collecting plate;

FIG. 14 is a cross-sectional view of the pores shown in FIG. 13; and

THE BEST MODES FOR CARRYING OUT THE INVENTION

Figure 1:
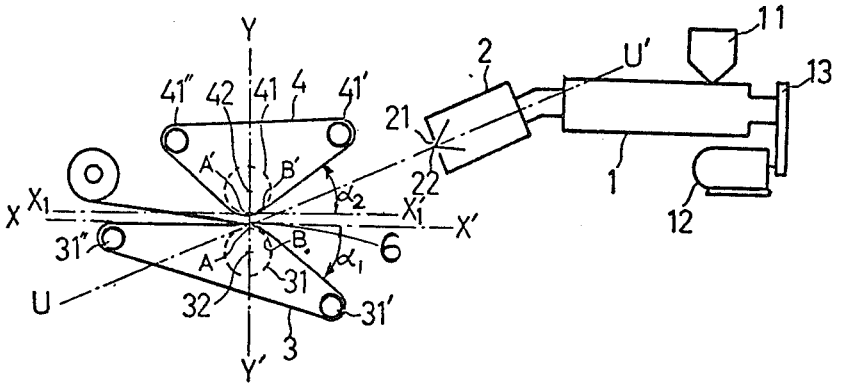
FIG. 1 is a schematic view showing an embodiment of the process of the present invention.
Figure 2:
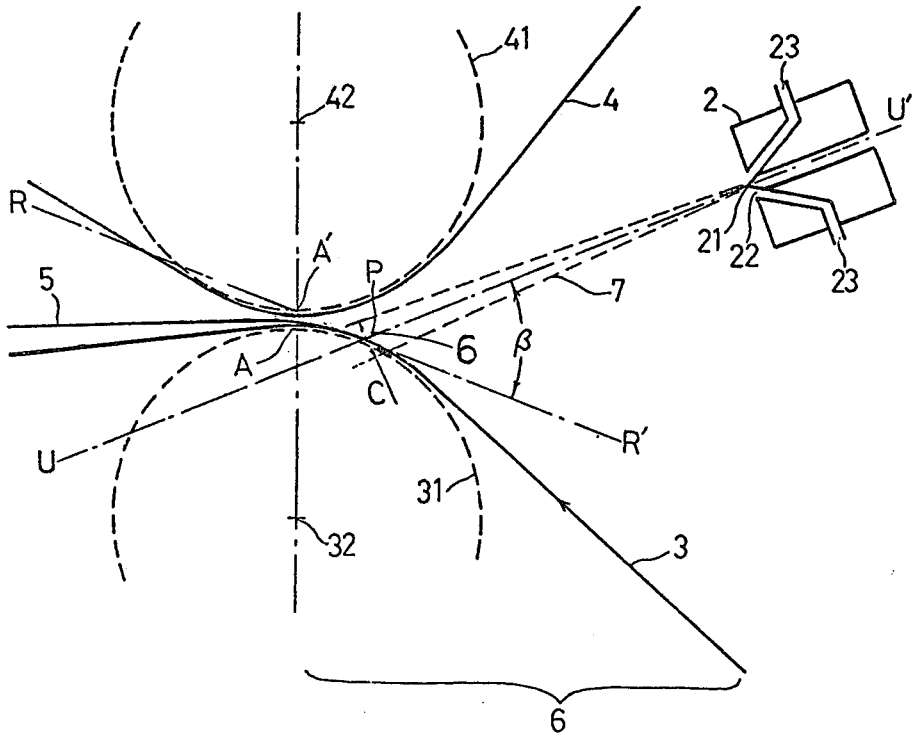
FIG. 2 is an enlarged view of an important portion of FIG. 1.

In FIGS. 1 and 2, a thermoplastic resin is fed to an extruder 1 from a hopper 11 of the extruder 1. The thermoplastic resin in the extruder 1 is milled by a screw (not shown) driven by a motor 12 and a power transmitting mechanism 13, and fed to a die 2 in a molten state. It is spun from spinning holes 21 and simultaneously stretched to fine fibers by a gas jetted at a high speed from gas discharging holes 22 provided adjacent to the spinning holes 21. The fine fibers form a gas stream 7 together with the gas. Then, the fiber stream 7 is blown onto a collecting plate 3 in such a manner that the central line U-U' of the fiber stream 7 is directed to a point P on the surface of the collecting plate 3 within a fiber-collecting zone 6 of a valley-like shape formed by the collecting plate 3 and the press plate 4. The fiber stream 7 blown onto the collecting plate 3 forms a nonwoven fabric 5 by separation of the gas from the fibers on the collecting plate. The nonwoven fabric 5 is compressed to a predetermined thickness by the collecting plate 3 and the press plate 4, if necessary, and them wound up as a final product.

The collecting plate 3 is supported by a hollow-cylindrical drum 31 and rolls 31' and 31'', and moves in the direction of an arrow shown in FIG. 2. The surface of the drum 31 (side surface of the cylindrical body but not end surface thereof) is provided with a large number of pores as shown in FIGS. 13 and 14. On the other hand, the press plate 14 is looped around a drum 41 and rolls 41' and 41''. The drum 41 has essentially the same structure as the drum 31 for the collecting plate 3.

The intersections of the surfaces of the drums 31 and 41 with a line connecting the center 32 of the drum 31 with the center 42 of the drum 41 are designated as points A and A', respectively. (The line 32-42 corresponds to the normals of the collecting plate 3 and the press plate 4 at the points A and A', respectively.) Between the points A and A', the collecting plate 3 and the press plate 4 form a contact region in which they are in contact with each other via the collected fibers. In the contact region, the normal Y-Y' of the collecting plate 3 at the point A coincides with the normal of the press plate 4 at the point A', and the points A and A' are opposed to each other at a predetermined interval.

The collecting plate 3 and the press plate 4 define a fiber-collecting zone 6 in an area upstream of the contact region. The fiber collecting zone 6 is of a valley-like shape formed by the collecting plate 3 and the press plate 4. The two converging surfaces of the valley are formed by the collecting plate and the press plate, and the bottom of the valley corresponds to an area where the two plates come into contact with each other via the fibers. More specifically, the fiber-collecting zone 6 is defined in FIGS. 1 and 2 as a valley-like area formed by the surfaces of the collecting zone 3 and the press plate 4 in which an angle $\alpha_1$ defined by the tangent X-X' of the surface of the collecting plate 3 at the point A and the tangent of the collecting plate 3 at a point (for example, point B) separated from the point A by an arbitrary distance "a" in the opposite direction to the movement of the collecting plate 3 is within the range of 0° to 90°, and an angle $\alpha_2$ defined by the tangent $X_1$-$X_1'$ of the surface of the presszplate 4 at the point A' and the tangent of the surface of the press plate 4 at a point B' separated from the point A' by a distance "a" in the opposite direction to the movement of the collecting plate 3 is also within the range of 0° to 90°.

Thus, in the fiber-collecting zone 6, the interval between the point B on the surface of the collecting plate 3 separated from the point A by a distance "a" in the opposite direction to the movement of the collecting plate 3 (shown by an arrow in the figures), and the point B' on the surface of the press plate 4 separated from the point A' by a distance "a" in the opposite direction to the movement of the collecting plate 3 increases as the distance "a" increases.

An angle at which the fiber stream consisting of fibers and a gas is blown onto a point P on the surface of the collecting plate 3 within the fiber-collecting zone, namely, an angle $\beta$ defined by the central line in the longitudinal cross section of the fiber stream (line U-U' in FIGS. 1, 2 and 10) and the tangent R-R' of the collecting plate at the point P is 0° to 90°, preferably 0° to 60°. When $\beta$ is 0°, i.e., the fiber stream is in parallel with the tangent at P, the fiber stream is blown onto the collecting plate 3 and the press plate 4. As a special case of $\beta=0°$, the central line U-U' of the fiber stream 7 may be directed between the point A of the collecting plate 3 and the point A' of the press plate 4. When $\beta$ is nearly 0° as described above, a nonwoven fabric in which fibers 121 are arranged substantially vertical to the surface 120 of the nonwoven fabric may be produced as shown in FIGS. 18(*a*) to (*c*), depending upon the relationship between the width C of the fiber stream 7 and the distance between A and A'. In particular, when such form of a nonwoven fabric is divided into two pieces along a central plane vertical to the thickness direction of the nonwoven fabric, a nonwoven fabric having fibers napped as shown in FIG. 18(*d*) may be obtained. Such a napped nonwoven fabric has not been able to be manufactured at all by conventional arts.

Next, a fiber-blown spot is indicated by a point P at which the central line U-U' of the fiber stream 7 is intersected with the surface of the collecting plate 3. A distance $\widehat{AP}$ is within 5 times, preferably 3 times the width C of the fiber stream 7 at the point P.

FIGS. 3 to 7 illustrate various shapes of the collecting plates 3 and the press plates 4 forming the fiber-collecting zone 6.

FIG. 3 shows the fiber collecting zone 6 formed by a flat part of the belt-like or ring-like collecting plate 3 and the press plate 4 supported around the hollow-cylindrical drum 41 having many holes or pores on the side wall. In this case, the drum or roll 31 for holding the collecting plate 3 is preferably a hollow cylinder having many holes on the side wall. However, if it has a small diameter, the provision of these holes is not always necessary. This drum or roll 31 can be omitted depending on the method of holding the collecting plate 3 (for example, a method in which the collecting plate 3 passes around rolls in the form of an annular endless belt). FIG. 4 shows a case where the relation of the collecting plate 3 and the press plate 4 in FIG. 3 is reversed. FIG. 5 shows a case where the collecting plate 3 and the press plate 4 are respectively wound around hollow-cylindrical drums 31 and 41 each having a number of holes. FIG. 6 shows a case where the collecting plate 3 and the press plate 4 are all hollow-cylindrical. FIG. 7 shows a case where the collecting plate 3 is hollow-cylindrical and the press plate 4 is a annular perforated plate 41 looped around hollow-cylindrical drums 41 and 41'.

In the above cases, the collecting plate 3 and the press plate 4 usually have linear surfaces in the cross section of the contact region taken along the line Y-Y' connecting the shafts 32 and 42 of the rolls or drums 31 and 41 for the collecting plate and the press plate. However, they may have various shapes of surfaces as shown in FIG. 8.

The directions of the movement of the collecting plate 3 and the press plate 4 are desirably the same at least at the points A and A' as shown in FIGS. 1 and 2. For example, however, the relative relationship of the moving directions of the collecting plate 3 and the press plate 4 as shown in FIG. 1 may be varied as shown in FIG. 9. If the moving directions of both plates are set as described above (FIG. 9) and the blow angle of the fiber stream is adjusted to 0°, a nonwoven fabric wherein fibers are greatly entangled is obtained. This makes this embodiment desireable.

FIG. 10 shows a gas flow in the fiber stream 7 in the process of the present invention. As shown in this figure, the gas in the fiber stream 7 may be readily withdrawn through the perforated plates on both sides of the point P. On the other hand, in a prior art using only a flat or cylindrical collecting plate having a large number of pores as shown in FIG. 11, a thermoplastic fiber stream is blown onto a point P on the collecting plate at which the fibers are collected. In this case, although the gas is exhausted through the pores of the collecting plate 3 in an area of the collecting plate on the side X' (upstream side of the collecting plate), the pores of the collecting plate on the side X (downstream side of the collecting plate) are clogged with the collected fibers, so that the gas flows in the direction of the movement of the collecting plate on the surface of the collected fibers in the area on the side X without being withdrawn through the pores of the collecting plate. This is a cause of disadvantages of prior arts as hereinabove mentioned.

Referring to FIG. 12 which shows another embodiment of an apparatus for carrying out the process of the present invention, the apparatus comprises an extruder 1, a hopper 11 of the extruder 1, a motor 12, a power transmitting mechanism 13 and a die 2 which is provided with spinning holes 21, gas discharging holes 22 and gas inlets 23. The gas inlets 23 are connected to a compressed gas feeding means (not shown). Reference number 3 indicates a collecting plate, which is a net or perforated plate made of a metal such as stainless steel or a synthetic resin such as polyester, polyamide or fluorine resin. It has pores of 5 to 200 mesh, preferably 10 to 40 mesh. Reference number 31 indicates a hollow-cylindrical drum for holding the collecting plate 3, having a diameter of about 1 m and a large number of holes on the side thereof (side as against the ends of the cylindrical body) as shown in FIGS. 13 and 14. The collecting plate 3 is provided on the side surface of the drum 31. The two end surfaces of the hollow-cylindrical drum may be provided with openings and are rotatably supported by such means as spokes like those used for wheels or supporting rolls mounted onto the inner wall of a drum, etc. However, said openings may be dispensed with depending on the case. The drum 31 may be driven by known methods such as a method in which a motor is connected with the central shaft 32 or a method comprising driving the drum through the inner or outer wall thereof. The drum 31 is provided with holes or pores 33 on the surface thereof. The holes 33 may be in any shape such as circle and slit, unless there is difficulty in the withdrawal of the blown gas. However, more preferable are circular tapered holes whose outer openings 35 have larger diameters than the inner openings 34 as shown in FIGS. 13 and 14. The sizes of the holes on the side wall of the drum 31 may optionally be determined depending on the relation with the structure of the collecting plate 3. In general, it is 1 to 50 mm, preferably 5 to 20 mm. Although this embodiment shows that the collecting plate 3 is held by the drum 31, the side wall itself of the drum may be used as a collecting plate.

Reference number 4 represents a press plate, which is an annular net or perforated plate made of a metal such as stainless steel or a synthetic resin such as polyester, polyamide or fluorine resin. It is looped around a hollow-cylindrical drum 41 of about 20 cm in diameter having a large number of holes on the side wall and a holding drum 41'. A fiber stream consisting of fibers spun from the spinning holes 21 of the die 2 and a gas jetted at a high speed from the gas discharging holes 22 is blown onto the surface of the collecting plate 3 at a point P (which is a point in cross section, but is a line in parallel with the central axis 32 of the collecting plate 3). The fibers are collected on the plate 3 and then pressed to a predetermined thickness by the collecting plate 3 and the press plate 4. The resulting nonwoven fabric 5 passes through rolls 71 and 71' and then is wound up by a roll 8 as a product. Reference number 9 represents a sprayer for feeding water drops to cool the collecting plate. In this example, furthermore, a suction means for exhausting the gas may, if necessary, be provided in the hollow-cylindrical drums 31 and 41.

FIG. 15 shows a modification of the system of FIG. 12. Press plate 4 is an annular net or perforated plate made of a metal such as stainless steel or a synthetic resin such as polyester, polyamide or fluorine resin, which is movably held by rolls 41, 41' and 41''. In this case, the roll 41 is coated with a synthetic rubber having a diameter of about 3 cm. The interval of the rolls 41' and 41'' is about 15 cm. The press plate 3 in the fiber collecting zone 6 is a substantially perforated plate, which provides the advantages of the present invention.

Figure 16:
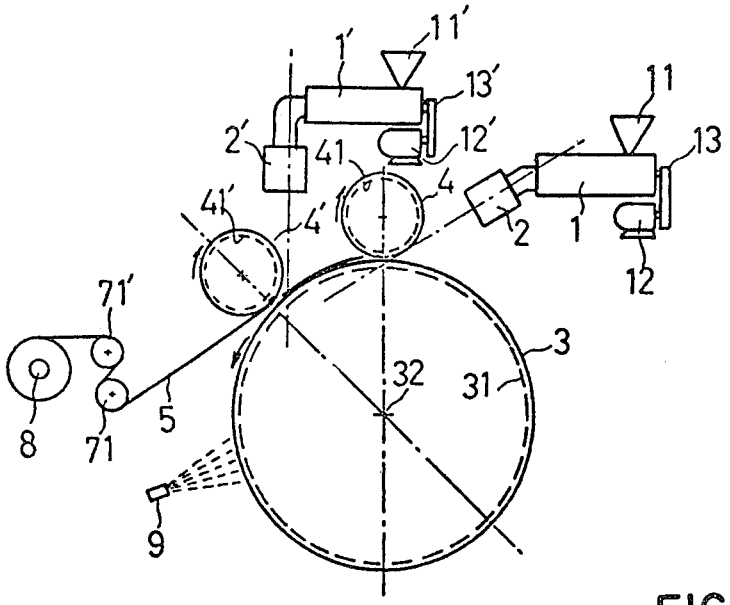
Figure 17:
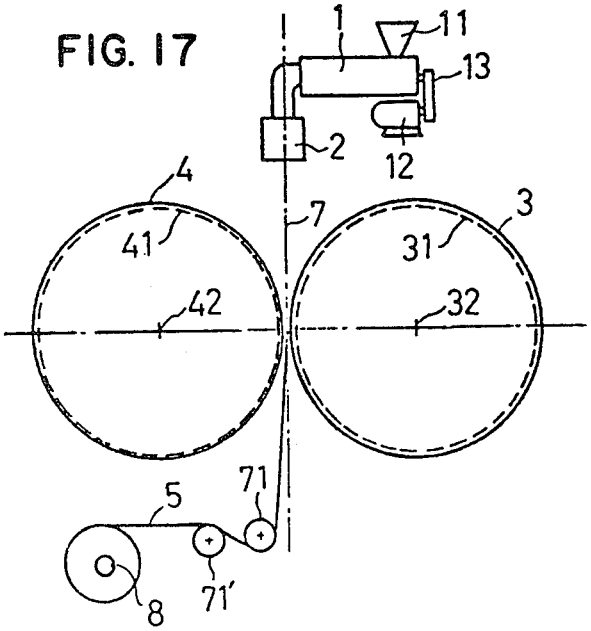
Figure 18A:
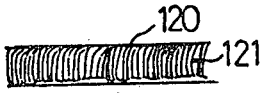
FIGS. 18(a), 18(b), 18(c), 18(d), 20(a) and 20(b) are cross-sectional views of the nonwoven fabrics prepared according to the present invention, respectively.
Figure 18B:
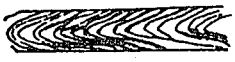
Figure 18C:
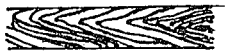
Figure 18D:
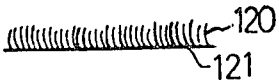

FIGS. 16 and 17 show other embodiments. FIG. 16 shows a case where a laminated article consisting of the same or different resins is produced using two spinning dies. FIG. 17 shows a case where a collecting plate 3 and a press plate 4 have the same shape and a fiber stream 7 is blown between these plates.

FIGS. 18(*a*), 18(*b*), 18(*c*) and 18(*d*) are schematic cross sectional views of the nonwoven fabrics obtained by blowing the fiber stream 7 between the collecting plate 3 and the press plate 4 as shown in FIG. 17. The resulting nonwoven fabric comprises fibers 121 substantially perpendicular to the surface 120 thereof [FIGS. 18(*a*) to (*c*)]. The division of this nonwoven fabric into two pieces along a central line provides a nonwoven fabric having fibers napped as shown in FIG. 18(*d*).

Figure 19:
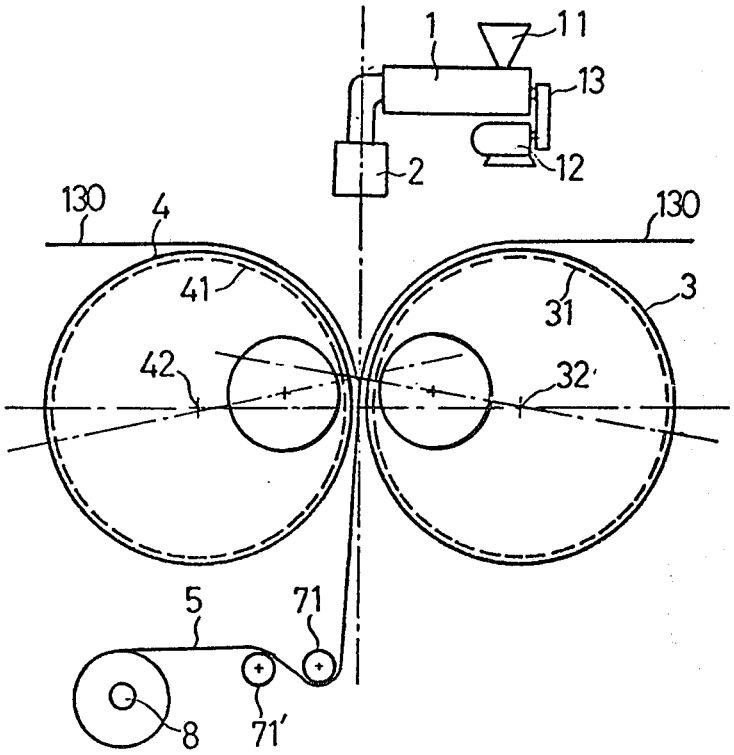

FIG. 19 shows a case where a fiber stream is blown onto woven or nonwoven fabrics 130 made of the same or different fibers from those of the fiber stream to produce a laminated nonwoven fabric having three layers.

Figure 20A:
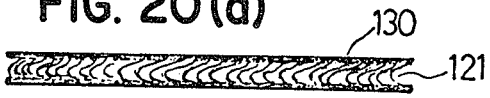
Figure 20B:
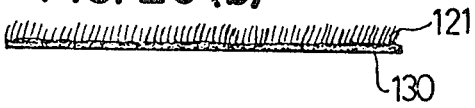

FIGS. 20(*a*) and 20(*b*) illustrate a nonwoven fabric which is manufactured by blowing a fiber stream onto woven or nonwoven fabrics 130 and laminating then according to a method such as shown in FIG. 19. Fibers in the laminated nonwoven fabric are indicated by the reference number 121. In this case, the woven fabric 130 may be made of synthetic fibers such as polyolefins, polyamides, polyesters, polyurethanes, polyacrylonitrile and the like and natural fibers such as cotton, hemp, silk and the like. The nonwoven fabric may also be made of the above synthetic fibers. It can be prepared by the process of the present invention. However, since the present process provides a nonwoven fabric consisting of fine fibers, nonwoven fabrics consisting of thicker fibers prepared by other known methods may be used, if necessary.

As fibers to be blown onto those woven or nonwoven fabrics, the above described synthetic fibers can be used.

When the thus obtained nonwoven laminate [shown in FIG. 20(*a*)] is divided into two pieces along a central line thereof, a nonwoven fabric having fibers napped as shown in FIG. 20(*b*) may be obtained. Moreover, in order to improve the adhesion of the woven or nonwoven fabrics to a nonwoven fabric to be laminated on said fabric, it is possible to heat the surfaces of the already existing woven or nonwoven fabrics or to apply a solvent or an adhesive to the surfaces of said fabrics.

Although the present invention has been explained referring to the drawings, it is not limited to the above described embodiments. Any modifications may be made to the present invention without deviating from the spirit of the present invention.

APPLICATION OF THE INVENTION IN INDUSTRY

Since nonwoven fabrics obtained by the process of the present invention have uniform structure, they may be advantageously utilized for electrical insulators, battery separators, filters, etc. Moreover, the nonwoven fabrics of the present invention prepared so as to have napped fibers have good hand which is not possessed by conventional nonwoven fabrics, when they are used for applications such as filters, carpets, synthetic leathers, etc.

What is claimed is:

1. In a process for the production of a nonwoven fabric comprising spinning continuously a molten thermoplastic resin from a plurality of spinning holes provided in a spinning apparatus thereby to spin fibers, while simultaneously jetting a gas at a high speed from gas discharging holes provided adjacent to the spinning holes to stretch the spun fibers out of the thermoplastic resin, thereby forming a fiber stream consisting of the fibers and the gas, then blowing the fiber stream into a collecting zone to form a mat wherein the improvement comprises:

directing said fiber stream into a fiber-collecting zone formed by two porous moving members having a gap therebetween having a large number of pores of 5 to 200 mesh therein, said members being arranged to come into contact with each other via the fibers to provide a contact region, said members having an angle of divergence of 0° to 90°, said gap between the two members increasing as the distance increases from said contact region in the opposite direction to the movement of said members, and blowing said fiber stream in said fiber-collecting zone in such a manner that the central plane of said fiber stream is directed within said fiber-collecting zone on at least one said porous member a distance from said contact region equal to less than at a point within 5 times the width of the fiber stream on said porous member, the angle at which the fiber stream is blown being 0° to 90°, the fibers being collected on said porous member or members while said gas is withdrawn through the pores of said members, whereby little gas flow passes over the surface of the resulting nonwoven fabric, and compressing said resulting nonwoven fabric, between said porous members to provide a nonwoven fabric of uniform thickness.

2. The process according to claim 1 wherein said members move continuously in the same direction.

3. The process according to claim 1 wherein the angle of blow is 0° to 60°.

4. The process according to claim 1 wherein the angle of blow is substantially 0° and both members are porous.

5. The process according to claim 4 wherein the fibers in the resulting nonwoven fabric are substantially perpendicular to the surface thereof.

6. The process for the production of a nonwoven fabric according to claim 1, wherein at least one of said porous members is in the shape of a hollow cylinder.

7. The process for the production of a nonwoven fabric according to claim 1, wherein at least one of said porous members is a belt-like or thin annular plate.

8. The process according to claim 1, wherein at least one of said porous members is a net or porous plate made of metal or a synthetic resin.

9. The process according to claim 1, wherein said net or porous plate is a woven net or punched porous plate made of metal or a synthetic resin having 10 to 40 mesh pores.

10. The process according to claim 1, 6, 7, 8 or 9, wherein at least one of said porous members is contacted with the outer side surface of a hollow cylinder having many through holes.

11. The process according to claim 10, wherein said through holes have a diameter of 1 to 50 mm.

12. The process according to claim 1, wherein the distance between the site on a porous member at which the central plane of the fiber stream is blown and said contact region is within 3 times the width of the fiber stream on the surface of said porous member.

13. The process according to claim 12, wherein the site on the porous member at which the central plane of the fiber stream is blown is located in said contact region.

14. The process according to claim 1 wherein at least one of said porous members is covered with a woven or nonwoven fabric, and the fiber stream is blown onto the surface of said woven or nonwoven fabric.

15. The process for the production of a nonwoven fabric according to claim 14, wherein at least one of said porous members is in the shape of a hollow cylinder.

16. The process for the production of a nonwoven fabric according to claim 14, wherein at least one of said porous members is a belt-like or thin annular plate.

17. The process according to claim 14, wherein at least one of said porous members is a net or porous plate made of metal or a synthetic resin.

18. The process according to claim 14, wherein said net or porous plate is a woven net or punched porous plate made or metal or a synthetic resin having 5 to 200 mesh pores.

19. The process according to any of claims 16 to 18, wherein at least one of said porous members is contacted with the outer side surface of a hollow cylinder having many through holes.

20. The process according to claim 19, wherein said through holes have a diameter of 1 to 50 mm.

21. The process according to claim 14, wherein the distance between the site on a porous member at which the central plane of the fiber stream is blown and said contact region is within 3 times the width of the fiber stream on the surface of said woven or nonwoven fabric.

22. The process according to claim 21, wherein the site on the porous member at which the central plane of the fiber stream is blown is located in said contact region.

23. The process according to claim 14, wherein said woven or nonwoven fabric provided on the porous member or members is heated.

24. The process according to claim 14, wherein said woven or nonwoven fabric provided on the porous member or members is coated with an adhesive.

* * * * *